US011006722B2

(12) United States Patent
Ohm

(10) Patent No.: US 11,006,722 B2
(45) Date of Patent: May 18, 2021

(54) REUSABLE ARTIFICIAL NAILS

(71) Applicant: Kiss Nail Products, Inc., Port Washington, NY (US)

(72) Inventor: Flori Taejueng Ohm, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 341 days.

(21) Appl. No.: 15/937,089

(22) Filed: Mar. 27, 2018

(65) Prior Publication Data

US 2019/0298031 A1 Oct. 3, 2019

(51) Int. Cl.
*A45D 31/00* (2006.01)

(52) U.S. Cl.
CPC ..... *A45D 31/00* (2013.01)

(58) Field of Classification Search
CPC ..... A45D 31/00; A45D 2031/005; A45D 2029/002; A45D 28/56; A61B 17/54
USPC ..... 132/285, 73
See application file for complete search history.

(56) References Cited

U.S. PATENT DOCUMENTS 4,709,657 A * 12/1987 Gothard ..... A01K 63/006 119/253
5,908,035 A * 6/1999 Carroll ..... A45D 31/00 132/73
2004/0000317 A1* 1/2004 Takahashi ..... A45D 31/00 132/73
2006/0102189 A1* 5/2006 Sirdesai ..... A45D 31/00 132/200
2006/0204702 A1* 9/2006 Thevenet ..... A45D 29/001 428/40.1
2014/0180356 A1* 6/2014 Shuros ..... A61N 1/0558 607/44
2016/0302550 A1* 10/2016 Cody Teichner ..... A45D 31/00
2019/0335874 A1* 11/2019 Chang ..... A45D 31/00

FOREIGN PATENT DOCUMENTS

CA 2285734 A1 * 4/2000 ..... B44C 1/18
DE 202012007892 U1 * 9/2012 ..... A45D 31/00
EP 2283742 A1 * 2/2011 ..... A45D 31/00
GB 403026 A * 12/1933 ..... A45D 31/00
WO WO-2017026790 A1 * 2/2017 ..... B32B 7/06

OTHER PUBLICATIONS

Translation of EP 2283742, 2011.*

* cited by examiner

*Primary Examiner* — Jacqueline T Johanas
*Assistant Examiner* — Thomas Drew Agger

(57) ABSTRACT

The present disclosure is directed to a reusable artificial nail. In one embodiment, the reusable artificial nail includes a first side having a decorative design and a second side that is opposite the first side, wherein the second side comprises a plurality of micro suction cups coupled to the second side.

8 Claims, 3 Drawing Sheets

REUSABLE ARTIFICIAL NAILS

BACKGROUND

Individuals use a variety of different accessories to decorate themselves. The different accessories can be used for a variety of different reasons. For example, the accessories can be used for fun to improve appearance or may be used for medical reasons. The different accessories may include wigs, hair extensions, false eyelashes, artificial fingernails, and the like.

Artificial fingernails are a popular decorative item. The artificial fingernails may be used to enhance the appearance of one's fingernails. The artificial fingernails may form an extension of the existing fingernail. The artificial fingernails allow different and complicated designs to be applied to a user's own fingernail.

Currently, artificial nails are glued onto a user's existing fingernails. The artificial nails are disposed of once the artificial nails are removed. In addition, the feeling of removing an artificial nail that is glued onto a user's existing fingernail may feel unpleasant. Furthermore, additional chemicals need to be purchased to remove the glue such as adhesive removers.

SUMMARY

In one embodiment, the present disclosure provides a reusable artificial nail. In one embodiment, the reusable artificial nail comprises a first side having a decorative design and a second side that is opposite the first side, wherein the second side comprises a plurality of micro suction cups coupled to the second side.

In another embodiment, the present disclosure provides another embodiment for a reusable artificial nail. The reusable artificial nail comprises a clear material having a first side and a second side and a plurality of micro suction cups coupled to the second side, wherein the plurality of micro suction cups are arranged into a decorative pattern that is visible through the clear material on the first side.

In another embodiment, the present disclosure provides a method for applying a reusable artificial nail. The method comprises applying a reusable artificial nail to an existing fingernail of a user, applying a pressure to engage a plurality of micro suction cups against a surface of the existing fingernail, removing the reusable artificial nail to disengage the plurality of micro suction cups, applying the reusable artificial nail to the existing fingernail of the user at a later time, and applying a pressure to engage the plurality of micro suction cups against the surface of the existing fingernail.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

Embodiments of the present disclosure provide a reusable artificial nail. As discussed above, artificial fingernails are a popular decorative item. The artificial fingernails may be used to enhance the appearance of one's fingernails. The artificial fingernails may be form an extension of the existing fingernail. The artificial fingernails allow different and complicated designs to be applied to a user's own fingernail.

Currently, artificial nails are glued onto a user's existing fingernails. The artificial nails are disposed of once the artificial nails are removed. In addition, the feeling of removing an artificial nail that is glued onto a user's existing fingernail may feel unpleasant. Furthermore, additional chemicals need to be purchased to remove the glue such as adhesive removers.

Embodiments of the present disclosure provide a reusable artificial nail that uses micro suction cups. As a result, additional chemicals such as adhesives and adhesive removers may no longer be needed. The unpleasant feeling of peeling off nails glued onto one's own existing nails can be eliminated. In addition, the micro suction cups may allow the artificial nails to be stored and reused at a later time. As a result, the user may change different artificial nail styles on a daily basis with ease.

In addition, the micro suction cups may allow a larger range of materials to be used to form the artificial nail. For example, the artificial nail may no longer be limited to acrylic nails fabricated from materials such as poly methyl methacrylate acrylic. Rather, the artificial nails may be formed from high quality materials such as gold, platinum, silver, gemstones, and the like.

Figure 1:
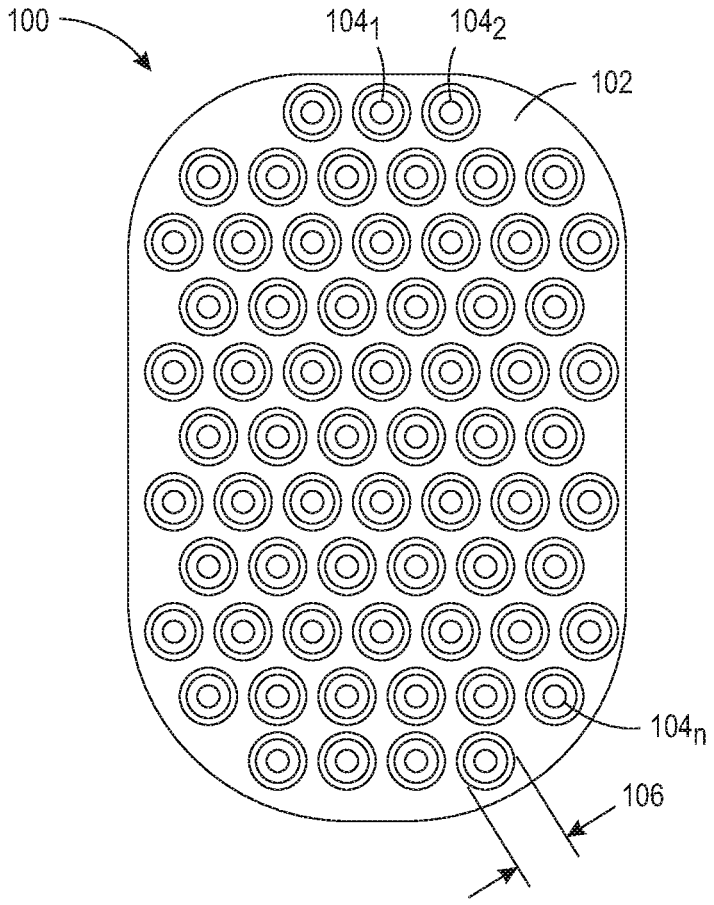
FIG. 1 depicts a bottom view of an example reusable artificial nail of the present disclosure.

FIG. 1 illustrates a bottom view of an example reusable artificial nail 100 of the present disclosure. In one embodiment, the reusable artificial nail 100 may include a plurality of micro suction cups 1041 to **104*n* (also referred to herein individually as a micro suction cup 104 or collectively as micro suction cups 104). The micro suction cups 104 may be coupled to a bottom side 102 of the reusable artificial nail 100**.

In one embodiment, the micro suction cups 104 may be fabricated from a flexible rubber material. Each one of the micro suction cups 104 may have a diameter 106 that is less than approximately 2 millimeters (mm). The micro suction cups 104 may be coupled to the bottom side 102 of the reusable artificial nail 100 via an adhesive or a glue.

As a result, the micro suction cups 104 can be applied to a surface of an existing fingernail of a user. The existing fingernail of the user provides a non-porous surfaces which the micro suction cups 104 can be applied to create a partial vacuum. The partial vacuum created by the micro suction cups 104 can hold the reusable artificial nail 100 against the existing fingernail of the user until a force is applied to the bottom side 102 and away from the existing fingernail of the user that overcomes the partial vacuum created by the micro suction cups 104.

The micro suction cups 104 allow the reusable artificial nail 100 to be removed without damage. As a result, the reusable artificial nail 100 can be reused over and over again. The micro suction cups 104 allow a user to change reusable artificial nails 100 with different decorative designs as frequently as he or she desires. As a result, the reusable artificial nail 100 can be worn similar to jewelry.

In addition, no adhesives or adhesive removers are necessary. Thus, the user may be able to prevent damage to the nail, there may be less nail care necessary, and the user can save costs on purchasing additional chemicals as the adhesive and adhesive removers are no longer required.

In one embodiment, the micro suction cups 104 may allow the reusable artificial nail 100 to be fabricated from a larger variety of different materials. For example, the reusable artificial nail 100 may be fabricated from an acrylic material, such as poly methyl methacrylate acrylic.

In another embodiment, the reusable artificial nail 100 may be fabricated from a metal or precious metal, such as gold, platinum, silver, and the like. In another embodiment, the reusable artificial nail 100 may add gem stone decorations such as emeralds, rubies, diamonds, sapphires, and the like.

In one embodiment, the micro suction cups 104 may be arranged on the second side 102 of the reusable artificial nail 100 in a shape that is substantially similar to a shape of the reusable artificial nail 100. The micro suction cups 104 may be spaced evenly apart from one another and cover substantially an entire surface area of the second side 102. As a result, the number of micro suction cups 104 that are deployed may be a function of a size, or dimensions, of the reusable artificial nail 100 and a shape of the reusable artificial nail 100.

In one embodiment, the micro suction cups 104 may be deployed in staggered rows as shown in FIG. 1. In other embodiments, the micro suction cups 104 may be deployed in aligned rows and columns.

Figure 2:
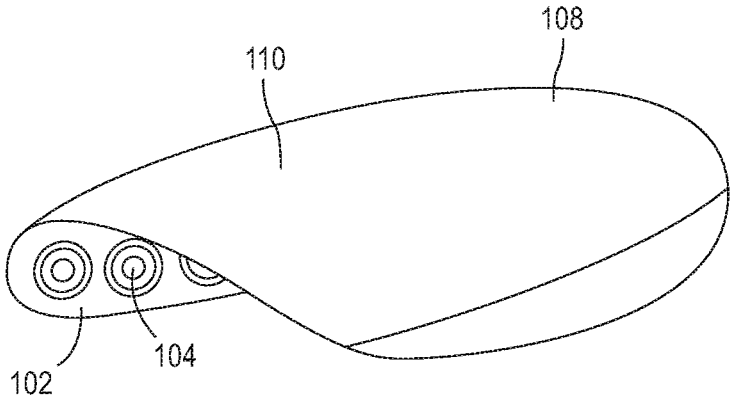
FIG. 2 depicts a side view of the example reusable artificial nail of the present disclosure.

FIG. 2 illustrates a side view of the reusable artificial nail 100. The reusable artificial nail 100 may include a first side or a top side 108. The top side 108 may include a decorative design 110. The decorative design 110 may be printed, painted, applied via a preprinted sticker, and the like, onto the top side 108 of the reusable artificial nail 100. The decorative design 110 may be any type of image, picture, logo, text, number, and the like.

A second side, or the bottom side 102, may be opposite the top side 108. As discussed above, the bottom side 102 may include the plurality of micro suction cups 104. The reusable artificial nail 100 may have an overall shape that matches the shape of an existing fingernail of a user. In other words, the reusable artificial nail 100 may have a curvature and a contour that matches the curvature and contour of the existing fingernail of a user.

In one embodiment, when a flexible material such as an acrylic material is used, the reusable artificial nail 100 may slightly bend to match the surface of the existing fingernail of the user. When the reusable artificial nail 100 is fabricated from a precious metal or gemstone, the reusable artificial nail 100 may be custom designed, cut, and built to match an individual's existing fingernail.

Figure 3:
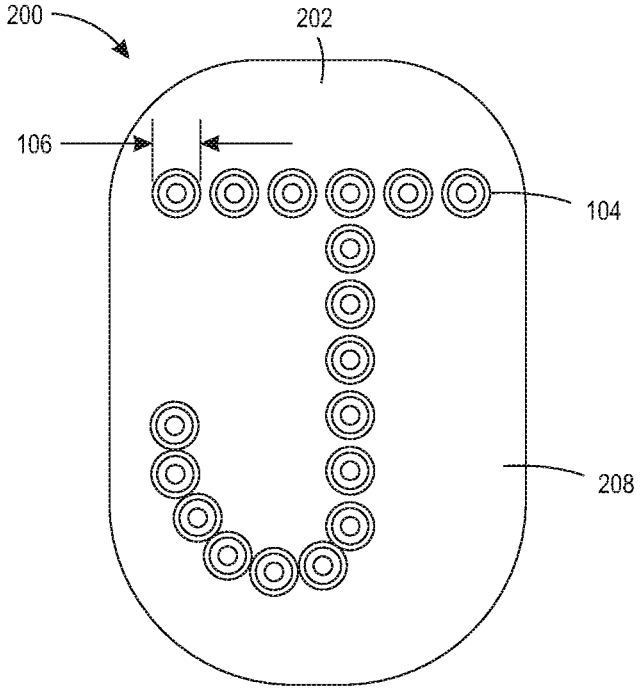
FIG. 3 depicts a top view of an example reusable artificial nail of the present disclosure.

FIG. 3 illustrates a top view of another example of a reusable artificial nail 200 of the present disclosure. In one embodiment, the reusable artificial nail 200 may be made of a clear acrylic material. The reusable artificial nail 200 may be shaped similar to an existing fingernail of a user similar to the reusable artificial nail 100, described above.

The reusable artificial nail 200 may also include a plurality of the micro suction cups 104. The micro suction cups 104 may be coupled to a bottom (also referred to as a second or underneath) side similar to the reusable artificial nail 100. The micro suction cups 104 may be similar to the micro suction cups 104 of the reusable artificial nail 100 in material, size, and dimensions.

Since the reusable artificial nail 200 is clear, the micro suction cups 104 may be visible from the bottom side and through a top (also referred to as a first) side 202. As a result, unlike the reusable artificial nail 100, the micro suction cups 104 may be arranged to form a decorative pattern 208. In other words, rather than painting, printing, or sticking a decorative pattern onto the top side 202, the micro suction cups 104 may be arranged to form the decorative pattern 208 on the bottom side of the reusable artificial nail 200.

In one embodiment, the decorative pattern 208 may be a letter, a number, an image, and the like. For example, the micro suction cups 104 may be arranged to form a letter. The user may have a first reusable artificial nail 200 that includes the micro suction cups 104 arranged to form a first initial and a second reusable artificial nail 200 that includes the micro suction cups 104 arranged to form a second initial. In another example, the micro suction cups 104 may be arranged to form a pattern of shapes, lines, and the like.

In one embodiment, the micro suction cups 104 may be coupled to the bottom side of the reusable artificial nail 200 via an adhesive. In one embodiment, the adhesive may be colored. For example, a colorant or dye may be added to the adhesive. As a result, the colored pattern may be visible through the clear acrylic nail. In one embodiment, different colored adhesives may be used for different micro suction cups 104 to create a desired colored pattern.

In one embodiment, the micro suction cups 104 may be arranged similar to the micro suction cups 104 of the reusable artificial nail 100. In other words, the micro suction cups 104 may be arranged in a shape that is similar to a shape of the reusable artificial nail 200. In addition, the micro suction cups 104 may substantially cover an entire surface area of the bottom side of the reusable artificial nail 200. The micro suction cups 104 may be spaced evenly apart from one another and be arranged in staggered rows or even rows and columns.

However, unlike the reusable artificial nail 100, the reusable artificial nail 200 may use colored adhesives to couple the micro suction cups 104 to the bottom side of the reusable artificial nail 200. As noted above, different colored adhesives may be used on different micro suction cups 104 to form the decorative pattern 208 out of the arranged micro suction cups 104. This may be in contrast to arranging the micro suction cups 104 into the desired pattern as illustrated in FIG. 3.

Figure 4:
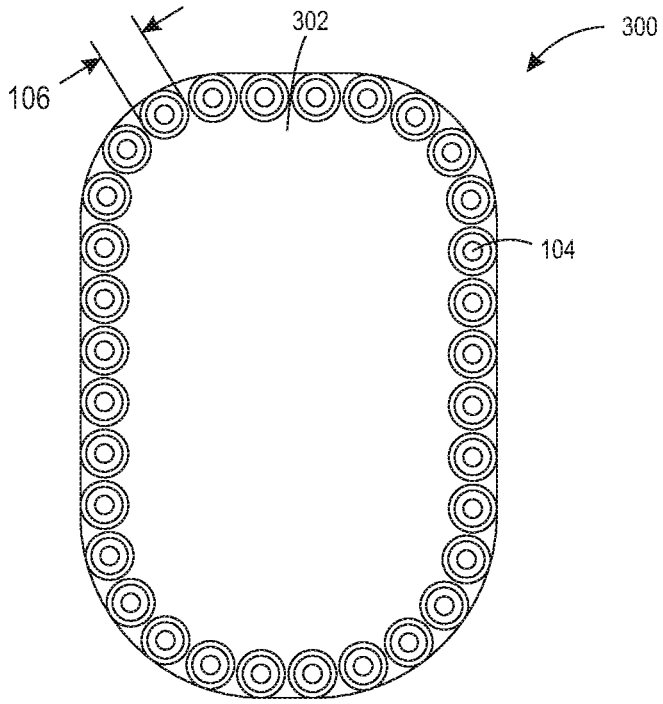
FIG. 4 depicts a bottom view of another example reusable artificial nail of the present disclosure.

FIG. 4 illustrates a bottom view of another example of a reusable artificial nail 300 of the present disclosure. In one embodiment, the reusable artificial nail 300 may be fabricated from an acrylic material or a metal similar to the reusable artificial nail 100 or a clear acrylic material similar to the reusable artificial nail 200, described above.

In one embodiment, the micro suction cups 104 may be located on a bottom side 302 of the reusable artificial nail 300. The micro suction cups 104 may have a diameter 106 that is similar to the diameter 106 on the reusable artificial nail 100 and 200, described above. For example, the diameter 106 may be approximately 2 mm.

In one embodiment, the micro suction cups 104 may be arranged along an outer perimeter of the reusable artificial nail 300. Thus, less micro suction cups 104 may be needed than the reusable artificial nail 100, while maintaining an adequate amount of suction force to maintain the reusable artificial nail 300 on the fingernail of the user.

In one embodiment, the size and shape of the reusable artificial nails 100, 200, and 300 may be any size or shape.

Thus, the reusable artificial nails 100, 200, and 300 may be manufactured to fit a variety of different shaped and sized fingernails with the micro suction cups 104 that are coupled and arranged, as described above.

Thus, the embodiments of the present disclosure provide a reusable artificial nail that does not require the use of any adhesives or adhesive removers. The reusable artificial nail can be collected and stored for continuous re-use over and over again, similar to wearable jewelry. The use of the micro suction cups allows a larger variety of materials to be used to form the artificial nail. In addition, the present disclosure provides a different way to create a decorative pattern 208 on the reusable artificial nail using the micro suction cups that are visible through a clear artificial nail.

Figure 5:
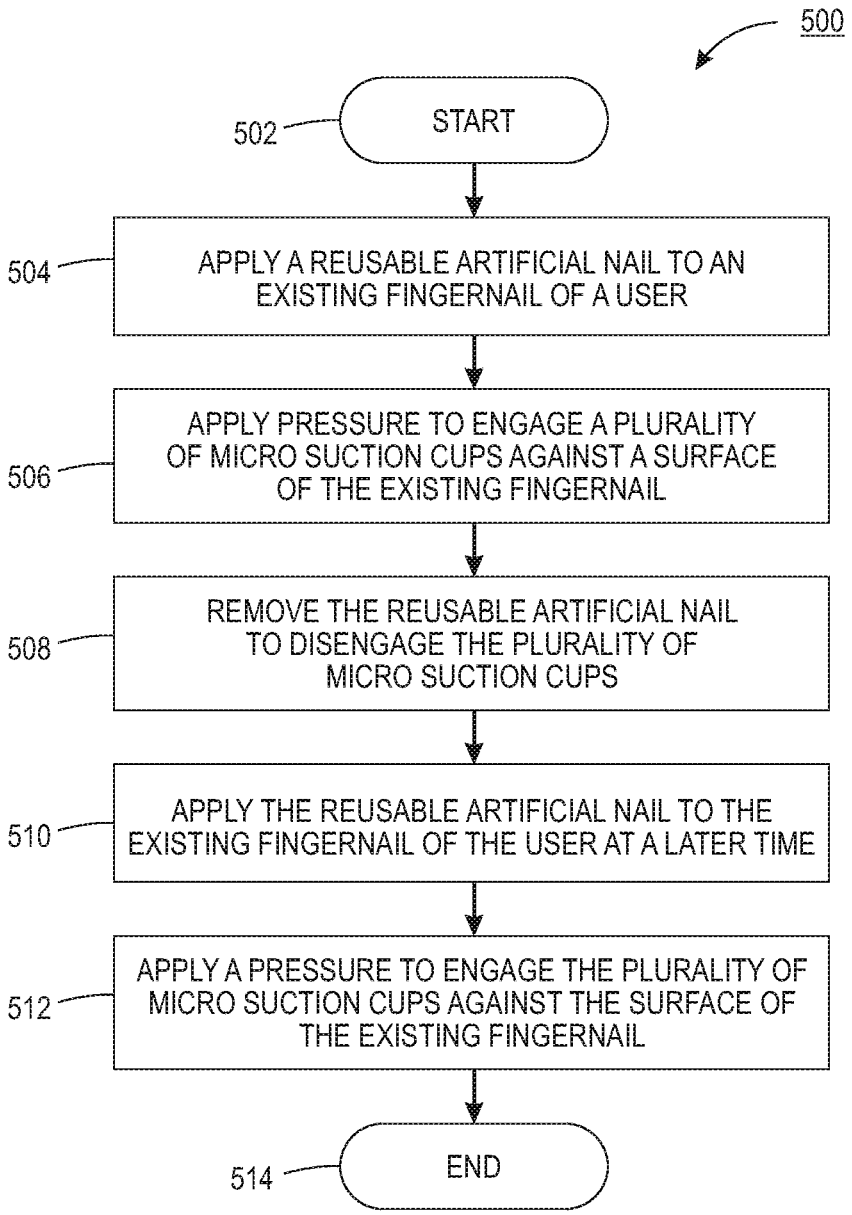
FIG. 5 depicts a flowchart of a method for applying a reusable artificial nail of the present disclosure.

FIG. 5 illustrates a flowchart of a method 500 for applying a reusable artificial nail in accordance with the present disclosure. The method 500 begins at block 502. At block 504, the method 500 applies a reusable artificial nail to an existing fingernail of a user. For example, the reusable artificial nail may be fabricated from an acrylic material, a metal, a gemstone, and the like. The artificial nail may have a design printed onto a top surface of the reusable artificial nail or be clear with a design formed by a plurality of micro suction cups, as described above.

As discussed above, a second side of the reusable artificial nail may have a plurality of micro suction cups. The plurality of micro suctions cups may each have a diameter that is less than approximately 2 mm. The plurality of micro suction cups may be spaced evenly apart from one another and arranged in a shape that is substantially similar to the shape of the reusable artificial nail. The plurality of micro suction cups may substantially cover the entire surface of the second side of the reusable artificial nail. In another embodiment, the plurality of micro suction cups may be arranged into a decorative pattern that can be seen through a clear reusable artificial nail.

At block 506, the method 500 applies a pressure to engage a plurality of micro suction cups against a surface of the existing fingernail. For example, the pressure applied and released may create a partial vacuum in each one of the micro suction cups against the surface of the existing fingernail. The partial vacuum may hold the reusable artificial nail against the existing fingernail without use of any adhesives.

At block 508, the method 500 removes the reusable artificial nail to disengage the plurality of micro suction cups. For example, a force may be applied on a bottom side of the reusable artificial nail that extends beyond the existing fingernail of the user and away from the existing fingernail of the user. The applied force may disengage the partial vacuum of the micro suction cups and allow the micro suction cups to release from the existing fingernail of the user.

At block 510, the method 500 applies the reusable artificial nail to the existing fingernail of the user at a later time. In other words, the reusable artificial nail may be removed in block 508 without damage since no adhesives or adhesive removers are used. The reusable artificial nail may be stored and reused at a later time.

At block 512, the method 500 applies a pressure to engage the plurality of micro suction cups against the surface of the existing fingernail. The pressure may allow the micro suction cups to create the partial vacuum and hold against the existing fingernail. The method 500 may be repeated to remove and reapply the same reusable artificial nail. At step 514, the method 500 ends.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A reusable artificial nail, comprising:

a first side having a decorative design; and a second side that is opposite the first side, wherein the second side comprises a plurality of micro suction cups coupled to the second side, wherein the plurality of micro suction cups is arranged only along an entire outer perimeter of the reusable artificial nail in a shape that is similar in shape and size to the perimeter of the second side of the reusable artificial nail.

2. The reusable artificial nail of claim 1, wherein the reusable artificial nail comprises an acrylic material.

3. The reusable artificial nail of claim 1, wherein the reusable artificial nail comprises a metal.

4. The reusable artificial nail of claim 3, wherein the metal comprises at least one of: gold, platinum, or silver.

5. The reusable artificial nail of claim 1, wherein the reusable artificial nail comprises a gem stone.

6. The reusable artificial nail of claim 1, wherein suction cups of the plurality of micro suction cups are evenly spaced between one another.

7. The reusable artificial nail of claim 1, wherein each suction cup of the plurality of micro suction cups has a diameter that is less than approximately 2 millimeters.

8. The reusable artificial nail of claim 1, wherein the plurality of micro suction cups is fabricated from a rubber material.

* * * * *